United States Patent [19]

Hackett

[11] 4,399,682

[45] Aug. 23, 1983

[54] METHOD FOR COLD FORMING METAL ARTICLES HAVING DIVERGING MEMBERS

[75] Inventor: Kenneth P. Hackett, Nashville, Tenn.

[73] Assignee: The Gleason Works, Rochester, N.Y.

[21] Appl. No.: 257,163

[22] Filed: Apr. 24, 1981

[51] Int. Cl.[3] ..... B21D 22/06

[52] U.S. Cl. ..... 72/359; 72/354; 72/377

[58] Field of Search ..... 72/354, 357, 359, 360, 72/377

[56] References Cited

U.S. PATENT DOCUMENTS 4,078,414 3/1978 Orain ..... 72/354

4,177,665 12/1979 Schurmann ..... 73/354

4,197,757 4/1980 Hackett ..... 72/264

*Primary Examiner*—Leon Gilden

*Attorney, Agent, or Firm*—Luedeka & Fitch

[57] ABSTRACT

A method for cold forming a metallic billet into an article having divergent members with a single hit comprises depositing the billet centrally within a die cavity between a first member and a second member. The first and second members are hydraulically urged toward one another at an equivalent velocity until the divergent portions of the die cavity are filled. The forming velocity is between about 30 percent and about 60 percent of the normal forming velocity for the material comprising the billet.

9 Claims, 4 Drawing Figures

METHOD FOR COLD FORMING METAL ARTICLES HAVING DIVERGING MEMBERS

The present invention relates to a method for cold forming metal and more particularly for cold forming articles having divergent members.

In a typical extrusion operation, a metal billet is deposited within a die cavity. A punch or anvil is inserted in the die cavity to define an annular space therebetween and held stationary while the billet is forced to extrude over and about the anvil, resulting in extrusion of the billet into and then out of the annular space between the die cavity and the anvil. In other operations, the anvil is itself moved relative to a stationary die cavity with resultant extrusion of the billet out of the die cavity through the annular space between the anvil and the die cavity wall.

There are a variety of shapes which have heretofore been quite difficult to reproduce using backward and/or forward extrusion without heating the metal prior to forming. One class of articles which has been particularly difficult to manufacture with a cold forming system comprises articles having cross-sectional dimensions substantially greater than the diameter of the billet. One example of such an article is a spider. Heretofore articles such as spiders have been manufactured by casting or by assembling several pieces. Castings suffer the deficiency of brittleness and are therefore incapable of absorbing the repeated shocks and stresses of many operations. Articles which are assembled from several pieces are expensive to manufacture, particularly where close tolerances are important. Also large amounts of material are lost in cutting and machining steps. In contrast, metal which is cold formed can be exceedingly strong and, if formed in a single hit rather than multiple hits, quite inexpensive to manufacture. Moreover, with suitable die construction and billet cutting, very close tolerances are attainable and the waste of material is reduced to a negligible level. The reduction of waste or scrap also reduces maintenance requirements and the down time of the forming apparatus.

Heretofore, efforts have been made to cold form spiders from billets. However, a problem which has proven quite difficult to overcome is the complete filling of the ends of the leg members. If the length of a leg is approximately equal to or greater than the diameter of the billet, it is quite difficult to properly fill the outermost portions of the die cavity. Unless the outermost portions of the die cavity are filled, the formed article is useless and must be scrapped. One solution to incomplete filling is to hit the article again, but such a solution is expensive, essentially doubling the cost of manufacture, and also leaves undesirable grain structure in the article. An article formed in a single hit develops a more desirable grain structure, i.e. the article is stronger than an article formed in a multiple hit operation.

It is therefore an object of the present invention to provide a method for cold forming metal into articles having divergent leg portions. It is also an object to provide a method for cold forming metal in a die cavity having divergent leg portions with a single hit. Various other objects and advantages will be apparent when the following description is considered in connection with the accompanying drawings in which:

FIGS. 1–3 are fragmentary representations, partly in section, of the sequence of operation of one embodiment of apparatus adapted for practicing various of the features of the invention;

FIG. 4 is a fragmentary top view of one embodiment of apparatus adapted for practicing various of the features of the invention and showing the apparatus in the closed position.

Figure 1:
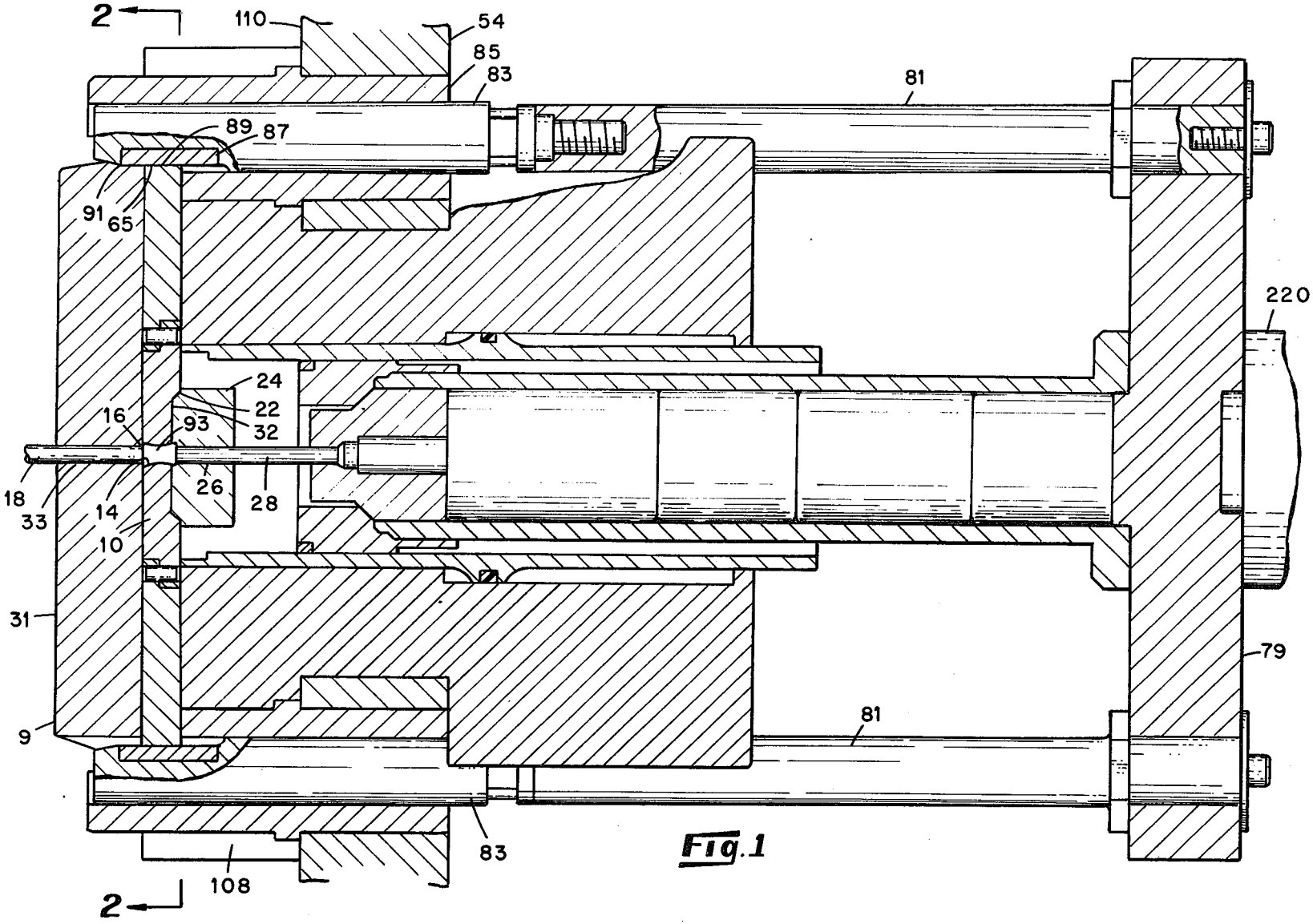
Figure 2:
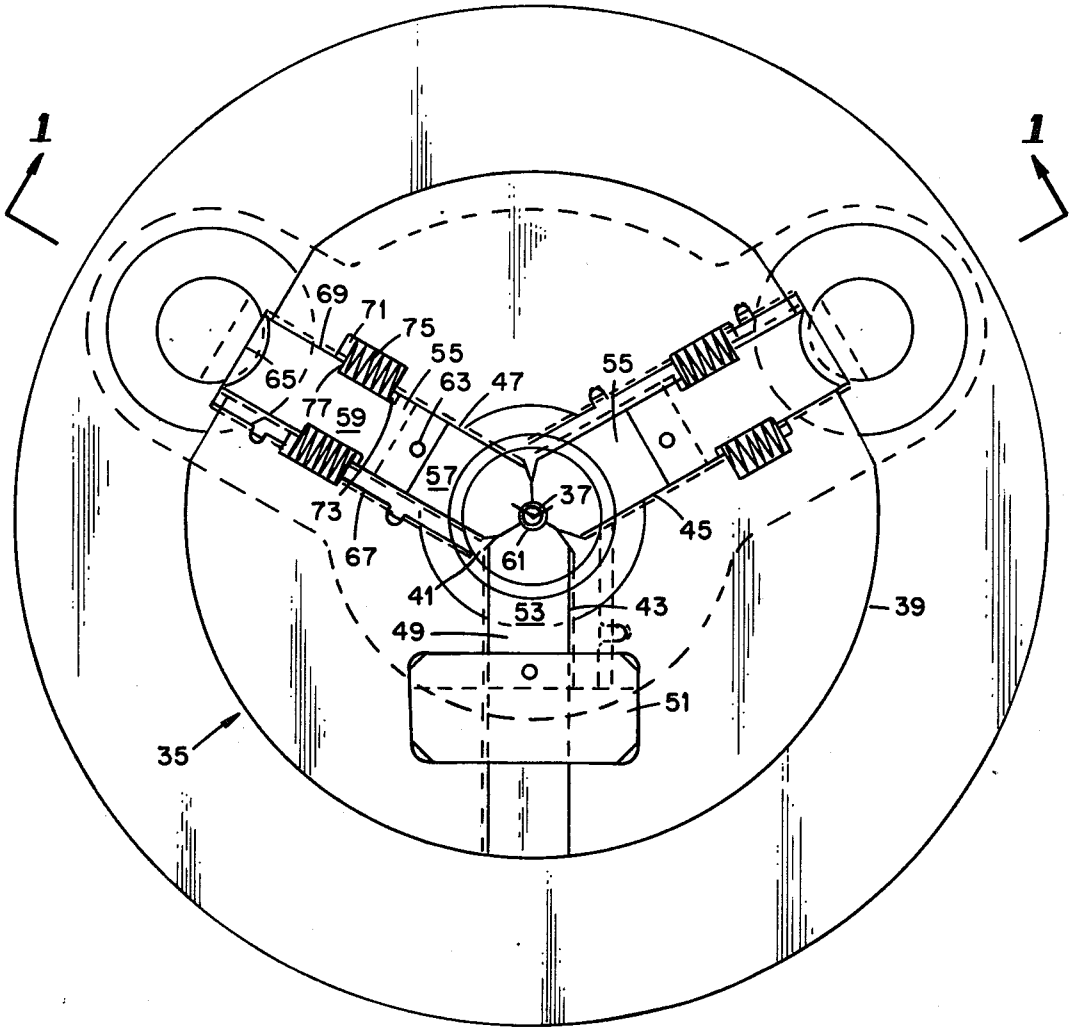

Referring now to the FIGURES, in FIGS. 1–3 is schematically depicted the steps of one embodiment of the present invention. A cylindrical metal billet 20 is inserted into a longitudinally separable die cavity 14 having a central bore and divergent leg portions. The die cavity 14, including the divergent leg portions, is defined by a stationary die nib member **10*a* and a longitudinally movable die nib member 10*b*. An elongated ram 18 advances the billet 20 rapidly through the die nib member 10*a* and into the die cavity 14, to contact an anvil 28 approaching from the opposite direction. The billet 20 is longitudinally confined between the ram 18 extending into the stationary die nib member 10*a* and the anvil 28 extending coaxially through the movable die nib member 10*b*. The speed of the ram and anvil are then reduced to an identical, relatively low velocity of about 140 to 170 inches per minute. As the ram 18 and anvil 28 symmetrically approach the die cavity, at identical velocities and opposing directions, the billet 20 is extruded into the divergent leg portions of the die cavity 14** at a rate whereby the entire die cavity is filled, heretofore unattainable lengths of divergent leg members are achieved and improved grain structure is developed, all with a negligible amount of scrap.

In FIG. 4, there is depicted one embodiment of apparatus for carrying out the disclosed method. The depicted apparatus comprises an improvement of the apparatus disclosed in U.S. Pat. No. 4,197,757, which is incorporated herein by reference. Where applicable, similar reference numerals will be used herein.

The view in FIG. 4 is looking down on the top of the apparatus and shows a plurality of plates 52 and 54 adapted to be supported on a suitable frame means (not shown). The plates 52 and 54 are preferably rectangular in form and are oriented in upright planes that are substantially parallel to one another, with the interconnection between the plates established and maintained by suitable rod members (not shown). Suitable means are provided for moving the plates 52 and 54 toward and away from one another for maintenance and repair.

The plate 54 is provided with a detachable first die stack holder 108 on its face 110, the holder being releasably secured to the face 110 as by bolts, for example. On the face 116 of the plate 52, and in facing relationship to the holder 108, there is provided a second die stack holder 118 which is releasably secured to the plate 52 as by bolts, for example. The tool stack 9, comprising the die nib **10*a* and shrink rings 12 and 126, is removably received between the holders 108 and 118**.

The holder 118 is further provided with a channel 132 defining a magazine for receiving a plurality of billets 20 in position for feeding into the die 10. These billets may be fed to the magazine by any suitable means such as are well known in the art.

In the embodiment depicted in FIG. 4, there is provided a tool stack 9 comprising a stationary die nib **10*a* surrounded by a shrink ring 12. The depicted die nib 10*a* is provided with a cavity 14*a* extending through the thickness of the die nib 10*a* and open at both of its ends. In accordance with the present disclosure, the cavity 14*a* includes a first cylindrical section 136*a* of substantially uniform cross-section along its length and a second section 138***a* having four radially extending, hemi-cylindrical leg portions 140*a*. The portions 140 are disposed at successive intervals of 90° about the axis of the cavity 14. The ram 18 is reciprocatively disposed within the section 136*a* to close the end 16*a* of the cavity 14*a*.

The power pad means 24, carrying a die nib member 10*b*, is adapted for reciprocable movement toward and away from the tool stack 9 along the axis of the die nib 10*a*. Like the die nib 10*a*, the die nib 10*b* is provided with a cavity 14*b* extending through the thickness of the die nib 10*b* and open at both of its ends. The cavity 14*b* includes a first cylindrical section 136*b* of substantially uniform cross-section along its length and a second section 138*b* having four radially extending, hemi-cylindrical leg portions 140*b*. The portions 140*b* are disposed at successive intervals of 90° about the axis of the cavity 14*b*. Within the bore 26 there is reciprocatively disposed an anvil 28.

The cavities 14*a* and 14*b* are thus mirror images of one another. The power pad die member 10*b* is adapted to facingly engage the die nib member 14*a* to cooperatively define a die cavity 14 in the shape of a spider having a central core and four radially diverging leg members.

The die nib member 10*b* is carried in an annular power pad member 24, which is in turn carried in an annular collar 34. The collar 34 is threadably mounted in the end 166 of a hollow cylindrical piston 168, which is in turn reciprocatingly received within a housing 170 having a reduced diameter end 172 mounted in the plate 54. The power pad 24 is provided in surrounding relationship to the die nib member 10*b* and collar means 34 is provided in surrounding relationship to the power pad 24 to provide for controlled application of pressure to the power pad 24 to selectively adjust its position relative to the die nib member 10*a*.

The outboard end of the anvil 28 is enlarged to define an anvil head 198. The anvil head 198 is mounted in a collet 200, which is in turn received in an externally threaded end 201 of a cylindrical tool holder 202. The end 201 is encircled by an internally threaded sleeve member 203 which is in turn slidably received within an axial bore 204 provided in the piston 168 such that the anvil 28 is axially movable relative to the piston 168, and to the power pad 24 which aids in maintaining the end 30 of the anvil 28 concentrically of the piston 168. As described more fully in U.S. Pat. No. 4,197,757, means are provided for reciprocatingly moving the anvil 28 and power pad 24 independently.

Power for reciprocating movement of the ram 18 is provided by apparatus substantially identical to the apparatus hereinabove described in connection with the reciprocating movement of the anvil 28 so that the foregoing description of the piston-cylinder apparatus that accomplishes reciprocating movement of the anvil 28 is sufficient for an understanding of the apparatus that provides for reciprocating movement of the ram 18.

In operation, viewing the apparatus as depicted in FIG. 4 the ram 18 is withdrawn to the left, past the channel 132 and a cylindrical billet 20 from the channel 132 is deposited in front of the ram 18. The ram 18 contacts the first end of the billet 20 and is then moved rapidly to the right, for example at about 450 inches per minute, a normal velocity for forming 8620 steel, to deposit the billet 20 within the die cavity 14. Simultaneously, the anvil 28 is pushed rapidly to the left, at a velocity of about 450 inches per minute, to contact the second, opposing end of the billet 20 as it enters the die cavity 14. That is, the billet 20 is engaged by the anvil 28 when it reaches the location at which the mid point of the billet 20 is located at the midpoint of the die cavity 14. The velocities of the anvil 28 and ram 18 are simultaneously reduced at this point to between 30% and 60%, preferably about 40%, of the normal forming velocity for the metal comprising the billet. In the case of 8620 steel, for example, for which 450 inches per minute is a normal forming velocity, the velocities of the ram and anvil are each reduced to about 192 inches per minute, until the billet 20 has flowed to completely fill the divergent leg portions of the die cavity 14, as depicted particularly in FIG. 2.

Thereafter, the power pad 24 is withdrawn to the right, followed by withdrawal of the anvil 28 to the right. The formed part 49 is then free to fall into a retrieval area (not shown) upon rightward extension of the ram 18, as under a spring load, for example. The power pad 24 and die nib member 10*b* are then returned into facing contact with the shrink ring 12 and die nib member 10*a*, respectively. The ram 18 is returned to the left to retrieve another billet 20 and the sequence is repeated.

The hydraulic and electronic control systems described in U.S. Pat. No. 4,197,757 provide that both the ram 18 and anvil 28 reach the die cavity 14 at the same time, though they are travelling from different distances. Electric eyes time the ram and anvil independently so that both arrive at the position to start forming at precisely the same time. The float control system generates equivalent amounts of hydraulic fluid per unit time for each of the ram and piston cylinders to maintain equivalent forming velocities.

It will be recognized that while the above described die nib includes four leg members radially spaced at 90° intervals, the presently described method may be applied as well to articles having portions which extend outwardly from a main body by a distance equivalent to or greater than the cross-sectional width of the starting billet.

The articles which are formed in accordance with the present invention require very little additional machine work and are exceedingly strong. Moreover, very little scrap is produced, resulting in considerable savings of material as well as in maintenance.

While a preferred embodiment of the present invention has been shown and described herein, it will be understood that there is no intent to limit the invention by such disclosure but rather, it is intended to cover all modifications falling within the spirit and scope of the invention as defined in the appended claims.

I claim:

1. A method for cold extrusion of a metallic billet into an article having stationary divergent members employing a die cavity having a central portion and a diverging portion, in a single uninterrupted motion, comprising the steps of:

depositing said billet within said central portion of said die cavity;

hydraulically urging a first member into contact with a first end of said billet;

hydraulically urging a second member into contact with a second end of said billet, said first end being opposite from said second end;

simultaneously urging said first member and said second member toward one another at an equivalent forming velocity until said billet has flowed to fill said stationary diverging portion, said forming velocity being between about 30% and about 60% of the normal forming velocity of about 450 inches per minute for the material comprising said billet.

2. The method of claim 1 wherein said forming velocity is about 40% of the normal forming velocity for the material comprising said billet.

3. The method of claim 1 wherein said billet comprises about 8620 steel and said forming velocity is about 190 inches per minute.

4. The method of claim 1 wherein said billet is deposited within said central portion of said cavity by said first member.

5. The method of claim 1 wherein said die cavity is defined by a stationary die nib member and an axially movable die nib member, said first member extending axially through said stationary die nib member and said second member extending axially through said movable die nib member.

6. The method of claim 1 wherein each of said die nib members includes a portion of said divergent portion of said die cavity.

7. The method of claim 1 wherein said divergent portion of said die cavity comprises a plurality of radially extending legs.

8. The method of claim 1 wherein said divergent portion has a length greater than the diameter of said billet.

9. The method of claim 1 wherein said forming velocity is between about 140 and about 170 inches per minute.

* * * * *